United States Patent [19]

Gemma

[11] Patent Number: 4,962,566

[45] Date of Patent: Oct. 16, 1990

[54] MACHINE FOR CLEANING TAPPED HOLES USED FOR AFFIXING THE COVERS TO ARMHOLES AND EYEHOLES IN STEAM GENERATORS

[75] Inventor: Antoine Gemma, Meudon, France

[73] Assignee: Electricité de France (Service National), Paris, France

[21] Appl. No.: 328,389

[22] Filed: Mar. 24, 1989

[30] Foreign Application Priority Data

Mar. 25, 1988 [FR] France ..... 88 03968

[51] Int. Cl.[5] ..... A46B 13/02

[52] U.S. Cl. ..... 15/304; 15/88.4; 15/104.1 R; 15/246; 15/246.5; 51/43

[58] Field of Search ..... 15/246.5, 21 E, 21 R, 15/104.1 R, 246, 301, 304; 51/43; 83/168

[56] References Cited

U.S. PATENT DOCUMENTS

| | | | |
|---|---|---|---|
| 1,659,301 | 2/1928 | Nelis . | |
| 3,810,710 | 5/1974 | Ennemoser | 408/111 |
| 4,419,847 | 12/1983 | Duverne | 15/104.1 R X |
| 4,485,517 | 12/1984 | Voigt | 15/21 R X |
| 4,805,253 | 2/1989 | Hanser | 15/246.5 |

FOREIGN PATENT DOCUMENTS 0282388 9/1988 France .

*Primary Examiner*—Chris K. Moore

*Attorney, Agent, or Firm*—Pollock, Vande Sande & Priddy

[57] ABSTRACT

A machine (3) for cleaning tapped holes (2) distributed around the periphery of an opening (1), e.g., those tapped holes used for peripherally bolting on a cover for an armhole or an eyehole in a steam generator of a nuclear power station. The machine comprises a grip (4) for centering and clamping the machine on the opening, thereby enabling it to be positioned on the axis (12) of the opening and to be held in position by abutment against the wall (10) of the opening; and a brush (13) disposed at a fixed radial distance from the axis of the opening. The brush is movable both in rotation about the axis (12) of the opening so that the trajectory of the brush describes a circle intersecting the axes of the various tapped holes distributed around the periphery of the opening, thereby enabling the brush to be selectively positioned over each of the tapped holes; and in axial translation along an axis coinciding with the axis of a tapped hole so as to enable the brush to be inserted into and withdrawn from the tapped hole.

7 Claims, 2 Drawing Sheets

1
2
3
4
5
6
7
8
9
10
11
12
13
14
15
16
17
18
19
20
21
22
23
24
25
26
27

MACHINE FOR CLEANING TAPPED HOLES USED FOR AFFIXING THE COVERS TO ARMHOLES AND EYEHOLES IN STEAM GENERATORS

FIELD OF THE INVENTION

The present invention relates to an apparatus for cleaning tapped holes distributed around an opening, particularly those which receive the peripheral bolts for holding the covers of orifices such as armholes and eyeholes in the stream generators of nuclear power stations.

BACKGROUND OF THE INVENTION

It will readily be understood that it is absolutely essential from the safety point of view for such eyeholes and armholes to be closed in an absolutely pressure-tight manner when the steam generator is in operation. However, it can happen that dirt in the threads of the tapped holes, in particular due to work that produces dust and debris in the vicinity of such eyeholes or armholes, prevents the covers of such orifices from being bolted into place properly, and this can give rise to safety problems when the steam generator is put back into operation.

It is therefore necessary, in particular after work has been performed, to clean very carefully all of the tapped holes used for bolting on covers.

In the past this operation has been performed manually. However, since the task is tedious (in particular because of the large number of tapped holes that need cleaning), it is often not performed completely reliably.

SUMMARY OF THE INVENTION

For this reason, the present invention proposes a machine for rationalizing these operations by positioning and displacing cleaning brushes in the tapped holes to be cleaned, such positioning and displacement being performed with very great accuracy and repeatability, and in addition, rendering the essential stages of the cleaning process suitable for being performed automatically or semi-automatically.

To this end, the apparatus according to the invention comprises:

means for centering and clamping the machine on said opening, thereby enabling the machine to be positioned on the axis of the opening and to be held in position by bearing against the wall of the opening; and brushing means disposed at a fixed radial distance from the axis of the opening and movable both:

- in rotation about the axis of the opening so that the trajectory of the brushing means describes a circle intersecting the axes of the various tapped holes distributed around the periphery of the opening, thereby enabling the brushing means to be selectively positioned over each of the tapped holes; and
- in axial translation along an axis coinciding with the axis of a tapped hole so as to enable said brushing means to be inserted into and withdrawn from the tapped hole.

Various other advantageous features may be provided, including indexing means may be provided for indexing the rotation of the brushing means relative to each of the tapped holes, which indexing means preferably comprise a retractable finger constrained to rotate with the brushing means and suitable for penetrating in one of the tapped holes other than the tapped hole over which the brushing means are positioned;

blowing and suction means co-operating with the brushing means;

a retractable suction hood surrounding the brushing means and pressing around the tapped hole so as to confine the suction volume to the tapped hole; and the centering and clamping means may include a radially expandable ring engaged between two end plates, one of which has a shoulder bearing against the rim of the opening.

BRIEF DESCRIPTION OF THE DRAWINGS

Other features and advantages will be apparent on reading the following detailed description of a preferred embodiment of the present invention, made with reference to the accompanying drawings, in which.

DESCRIPTION OF THE PREFERRED EMBODIMENT

Figure 1:
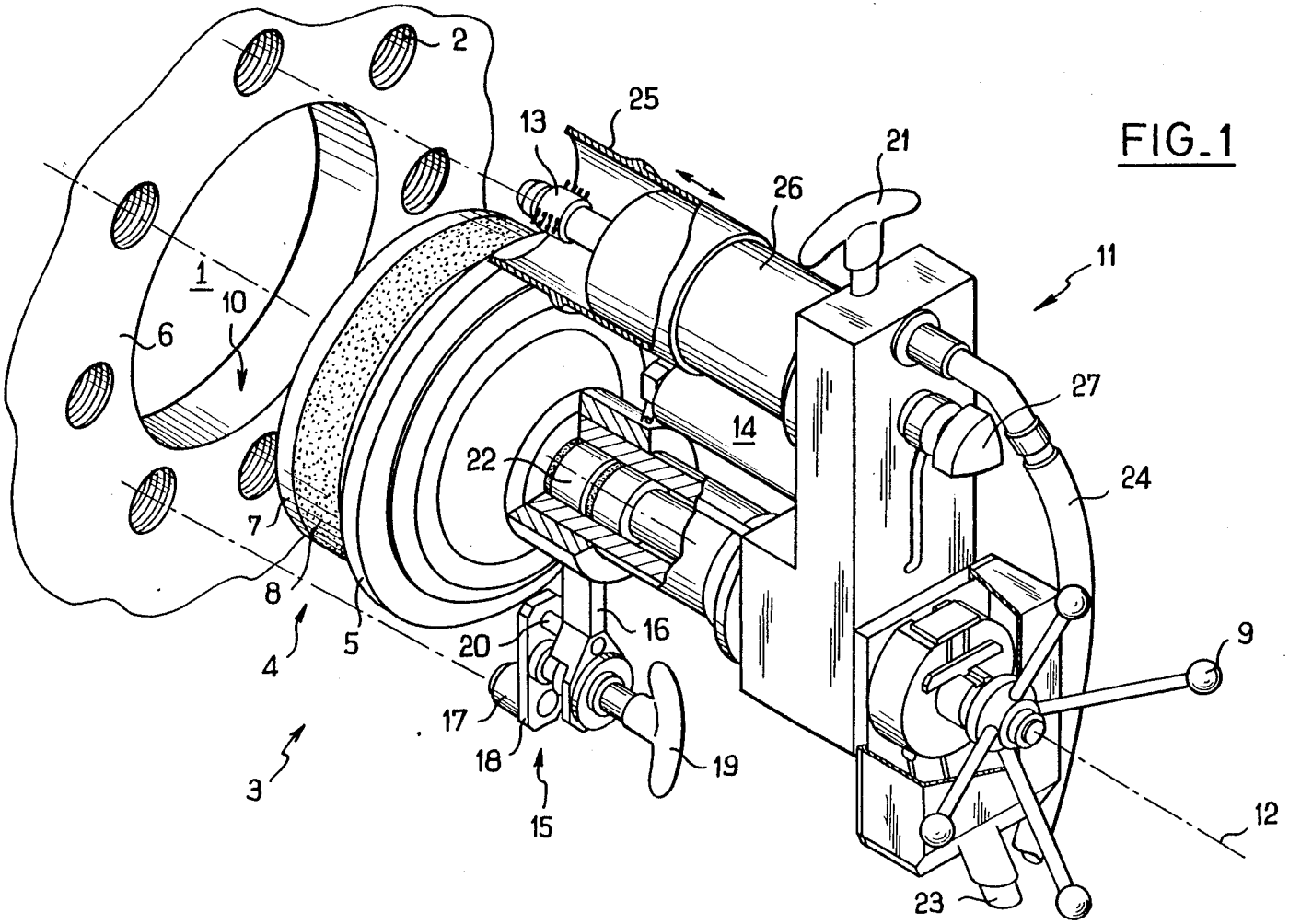
FIG. 1 is a perspective view of a machine for cleaning tapped holes used for bolting an armhole cover onto a steam generator in a nuclear power station.
Figure 2:
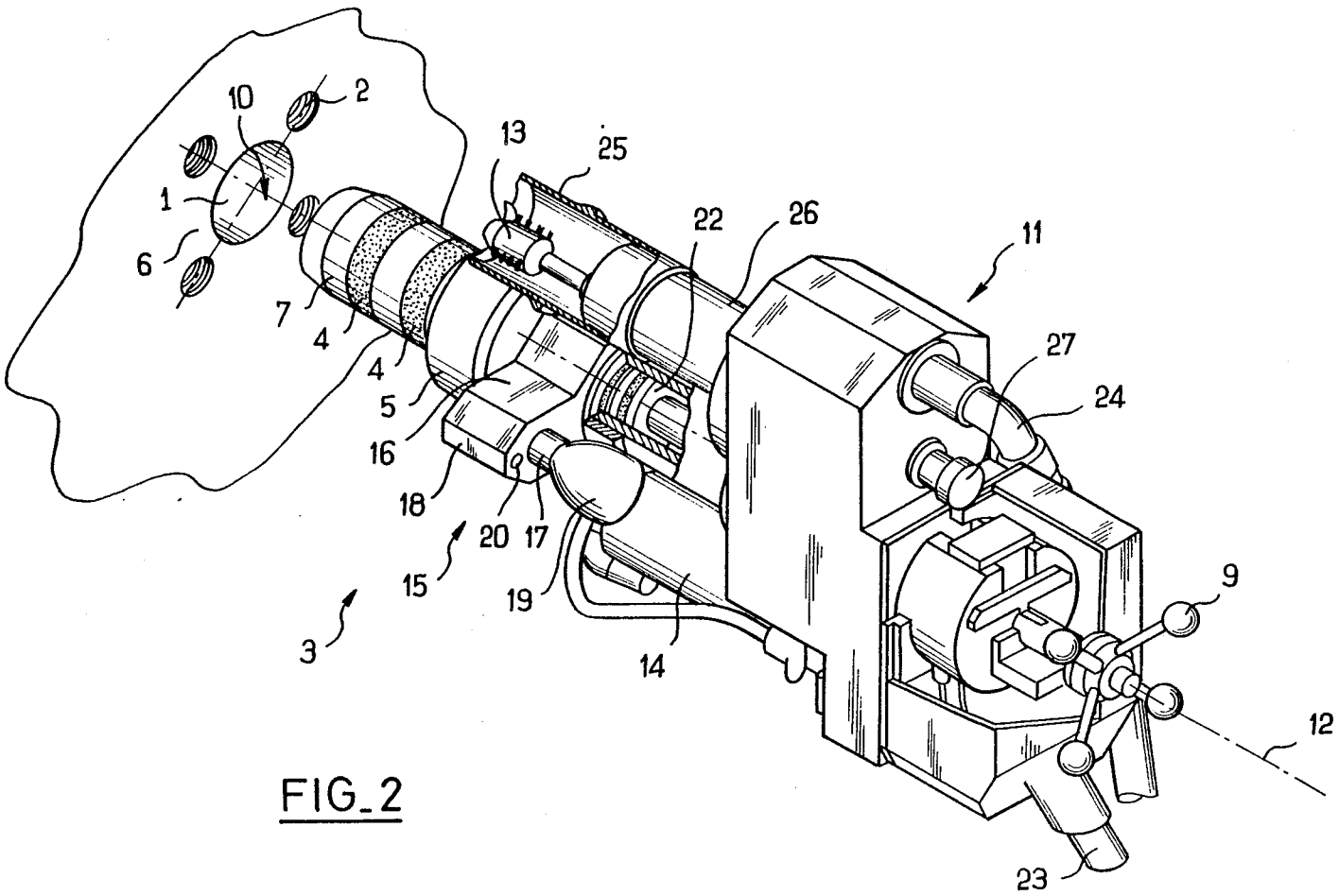
FIG. 2 is a perspective view of a machine for cleaning tapped holes used for bolting an eyehole cover onto a steam generator in a nuclear power station.

FIGS. 1 and 2 which show machines having the same structure and operating in the same manner, but having parts of different dimensions, depending on whether cleaning is to be performed around an armhole (FIG. 1) or around an eyehole (FIG. 2), with the eyehole being much smaller than the armhole, thereby making it possible to use for the latter machine which is similar in structure but considerably more compact.

In the drawings, reference 1 designates the armhole (FIG. 1) and the eyehole (FIG. 2), generically referred to below as the "orifice", which orifice is surrounded by a plurality of regularly spaced-apart tapped holes 2 for use in bolting on a cover for said orifice 1.

The machine 3 firstly comprises means 4 for centering the machine relative to the orifice 1 and for clampling it thereto, thereby enabling the axis of the machine to be located accurately coincidently with the axis of the orifice, and also serving to hold the machine in place by bearing against the wall or the orifice such that the body of the machine and the wall of the duct through which the orifice 1 extends are securely held together without the machine being externally supported.

These centering and clamping means 4 comprise a first plate 5 of slightly greater diameter than the orifice 1 so as to present a shoulder which bears against the rim 6 of said orifice, together with another end plate 7 which penetrates into the orifice while leaving as little clearance as possible.

A radially expandable element such as a resilient ring 8 is disposed between the end plates 5 and 6, and this ring expands when the end plates 5 and 6 are moved towards each other, by the operator turning a capstan 9. The machine is then clamped in place by pressure of the ring 8 against the wall 10 of the orifice 1.

The stationary portion of the cleaning machine fixed in this way to a steam generator duct supports moving equipment 11 capable of rotating about the central axis 12 of the machine, which axis is brought into alignment with the axis of the orifice 1 by the centering means 4.

The moving equipment 11 has a rotary brush 13 which is driven by a unit comprising a pneumatic motor and a stepdown gear box.

The rotary brush 13 can be placed over each of the tapped holes 2 by rotating the moving equipment 11.

In order to ensure that the brush is placed exactly over each of the holes, indexing means 15 are provided comprising, for example, a cylinderical finger 17 disposed at the end of an arm 16 fixed to rotate with the moving equipment 11, said finger having the same diameter (to within small clearance) as the inside diameter of the tapped holes 2. The finger 17 is mounted on a plate 18 which is movable axially relative to the arm 16 when a handle 19 is actuated by the operator.

Thus, the finger 17 can be moved over each of the holes 2, and by operating the handle 19 it can be inserted into the hole, thereby preventing the moving equipment 11 from rotating. The position of the arm is such that, once it has been prevented from rotating in this way, the brush 13 lies very accurately on the axis of one of the holes 2, e.g., the hole diametrically opposite to the hole receiving the finger 17, or some other one of the holes.

In order to avoid damaging the tapping in a hole after a brushing operaion has been completed and when the finger 17 which was received in the hole is extracted therefrom, an additional finger 20 is provided for pressing against the duct near to the hole, thereby avoiding the application of any large forces which could damage the tapping in the hole.

Once the indexing operation has been performed by the finger 17 penetrating into one of the holes (with rotation of the moving equipment being optionally facilitated by use of a handle 21), the brushing means are displaced in axial translation so as to cause the brush 13 to penetrate into the tapped hole to be cleaned. This displacement motion is performed, for example, by means of a hydraulic actuator 22 fed from a hose 23 so as to cause the brush 13 to move backwards or forwards.

Finally, means are provided for blowing air along the axis of the brush in order to facilitate unsticking particles and dust, and suction means are also provided for sucking up any such particles or dust that may be released, with said suction passing via a suction hose 24 which sets up a large pressure reduction in the vicinity of the tapped hole to be brushed. In order to reinforce the suction effect, a suction hood 25 is retractably mounted on a stationary portion 26 so that the leading end of the retractable hood can be placed around the periphery of the tapped hole throughout the brushing operation.

In addition, an operating button 27 connected to the brush 13 enables the operator to withdraw the brush if necessary (e.g., for cleaning purposes), without it being necessary to dismantle the machine and separate it from the orifice 1.

The machine operates as follows:

(1) The operator centers the machine in the orifice 1 until the shoulder on end plate 5 bears against the rim 6 of the orifice;

(2) The brushing head 13 is positioned by indexing the machine by engaging the finger 17 in one of the tapped holes;

(3) The capstan 9 is then operated to clamp the machine in position relative to the orifice 1;

(4) After the various pneumatic hydraulic and electrical feeds have been connected to a control box, the brush is put into operation, as are blowing and suction via the hose 24;

The machine then performs one or more cleaning cycles with the actuator 22 operating under automatic control from the control box (with the head of the brush 13 moving in and then out of the tapped holes, once per cycle); and After the machine has returned to its initial position, it is de-indexed (the finger 17 is withdrawn) and then re-indexed in an adjacent hole (the finger 17 is re-engaged), and the cleaning cycle is perfomred on the next hole.

What is claimed is:

1. Machine (3) for cleaning tapped holes (2) distributed around the periphery of an opening (1), said machine comprising (a) means (4) for centering and clamping said machine on said opening, thereby enabling said machine to be positioned on the axis (12) of the opening and to be held in position by abutment against a wall (10) of said opening; and (b) brushing means (13) disposed at a fixed radial distance from said axis of said opening and movable both:

(i) in rotation about said axis (12) of said opening so that a trajectory of said brushing means describes a circle intersecting the axes of tapped holes distributed around a periphery of said opening, thereby enabling said brushing means to be selectively positioned over each of said tapped holes; and (ii) in axial translation along an axis coinciding with the axis of a tapped hole so as to enable said brushing means to be inserted into and withdrawn from said tapped hole;

(c) said brushing means including a rotary brush rotating about an axis coincident with said axis of said tapped hole, whereby said axial translation performs a cleaning cycle by moving said rotating brush in and then out of said tapped hole.

2. A machine according to claim 1, comprising indexing means (15) for indexing the rotation of said brushing means relative to each of said tapped holes.

3. A machine according to claim 2, wherein said indexing means comprise a retractable finger (17) constrained to rotate with said brushing means and adapted to penetrate into one of the said tapped holes other than the tapped hole over which said brushing means are positioned.

4. A machine according to claim 1, further including blowing and suction means (24) co-operating with said brushing means by blowing air along the axis of the same in order to facilitate unsticking particles and dust and for sucking up any such particles or dust that may be released.

5. A machine according to claim 4, comprising a retractable suction hood surrounding said brushing means and pressing around said tapped hole so as to define a suction volume confined to said tapped hole throughout said cleaning cycle.

6. A machine according to claim 1, wherein said centering and clamping means include a radially expandable ring (8) engaged between two end plates (5, 7), one of which has a shoulder bearing against a rim (6) of said opening (1).

7. A machine according to claim 1, wherein said tapped holes are used for peripherally bolting on a cover for an armhole or eyehole in a steam generator of a nuclear power station.

* * * * *